US008585160B2

(12) United States Patent
Atkins

(10) Patent No.: US 8,585,160 B2
(45) Date of Patent: Nov. 19, 2013

(54) ADJUSTABLE FOOD SHIELD

(71) Applicant: Brass Smith, LLC (BSI Designs), Denver, CO (US)

(72) Inventor: Scott Atkins, Denver, CO (US)

(73) Assignee: Brass Smith, LLC (BSI Designs), Denver, CO (US)

( * ) Notice: Subject to any disclaimer, the term of this patent is extended or adjusted under 35 U.S.C. 154(b) by 0 days.

(21) Appl. No.: 13/848,843

(22) Filed: Mar. 22, 2013

(65) Prior Publication Data

US 2013/0221815 A1 Aug. 29, 2013

Related U.S. Application Data

(62) Division of application No. 13/022,387, filed on Feb. 7, 2011, now Pat. No. 8,403,430.

(51) Int. Cl.
*A47F 9/00* (2006.01)

(52) U.S. Cl.
USPC ..... 312/137; 248/122.1; 403/97

(58) Field of Classification Search
USPC ..... 312/140.1–140.4, 137; 108/5–8; 211/150, 187, 190; 248/122.1, 276.1, 248/284.1; 16/334; 403/97
See application file for complete search history.

(56) References Cited

U.S. PATENT DOCUMENTS

| | | | |
|---|---|---|---|
| 54,248 | A | 4/1866 | Eddy |
| 90,297 | A | 5/1869 | Perry et al. |
| 93,763 | A | 8/1869 | Stoddard |
| 147,362 | A | 2/1874 | Boudren |
| 255,123 | A | 3/1882 | Starrett |
| 257,646 | A | 5/1882 | Beseler |
| 342,650 | A | 5/1886 | Smith |
| 369,143 | A | 8/1887 | White |
| 369,971 | A | 9/1887 | Stillman |
| 384,784 | A | 6/1888 | Pihl |
| 406,299 | A | 7/1889 | Overpack |

(Continued)

FOREIGN PATENT DOCUMENTS

WO 9850728 A1 11/1998

OTHER PUBLICATIONS

1 Guard Portable Brochure, downloaded on or before Oct. 9, 2007, 1 page.

(Continued)

*Primary Examiner* — Darnell Jayne
*Assistant Examiner* — Ryan A Doyle
(74) *Attorney, Agent, or Firm* — Kilpatrick Townsend & Stockton LLP

(57) ABSTRACT

An adjustable food shield includes a panel mounting mechanism that enables extensive adjustability of the food shield. The food shield may include a post having a longitudinal axis, and a carrier coupled to the post, the carrier including a carrier clamping mechanism. The carrier clamping mechanism is loosenable to enable the carrier to be moved along at least a portion of the length of the post, and is also tightenable to fix the carrier at a certain location on the post. The mounting mechanism may also include a link having a proximal end pivotally coupled to the carrier. An arm may be pivotally coupled to the distal end of the link and extend from the link. The adjustable food shield may include a clear panel coupled to the arm such that the clear panel is movable to different positions by rotating the link, the arm, or both.

25 Claims, 10 Drawing Sheets

(56) References Cited

U.S. PATENT DOCUMENTS 423,434 A 3/1890 Lotto
432,614 A 7/1890 Hendrick
462,319 A 11/1891 Loehner et al.
476,806 A 6/1892 Mauser
502,601 A 8/1893 Anderson
517,677 A 4/1894 Bender
546,081 A 9/1895 Reyer
551,358 A 12/1895 Benecke
554,459 A 2/1896 Rockwell
555,025 A 2/1896 Ruffhead et al.
557,575 A 4/1896 Gibson et al.
560,879 A 5/1896 Williams
566,360 A 8/1896 White
568,649 A 9/1896 Whittington
575,711 A 1/1897 Haley
575,857 A 1/1897 Sly
576,769 A 2/1897 Williams
577,974 A 3/1897 Williams
578,014 A 3/1897 Homan
581,991 A 5/1897 Homan
585,406 A 6/1897 Rhind
596,689 A 1/1898 Aungst
596,762 A 1/1898 Sevison
597,947 A 1/1898 Bragger
599,467 A 2/1898 Beardsley
600,642 A 3/1898 Hartman
621,374 A 3/1899 Rhind
625,944 A 5/1899 White
632,858 A 9/1899 Waibel
642,906 A 2/1900 Hedgeland
663,121 A 12/1900 Frost
763,380 A 6/1904 Eble et al.
767,484 A 8/1904 Maltby
795,602 A 7/1905 Fyfe
842,007 A 1/1907 Parker
842,313 A 1/1907 Harrison
903,593 A 11/1908 Lowendahl
926,114 A 6/1909 Hall
926,840 A 7/1909 Bagaason
953,156 A 3/1910 Rasmussen
959,099 A 5/1910 Anderson
963,913 A 7/1910 Lyhne
964,840 A 7/1910 Bernau
970,751 A 9/1910 Pranke
1,047,817 A 12/1912 Knight
1,056,574 A 3/1913 Newton
1,057,658 A 4/1913 Nichols
1,074,272 A 9/1913 Kline
1,094,272 A 4/1914 Thornley
1,106,485 A 8/1914 Becker
1,132,554 A 3/1915 Brett
1,137,333 A 4/1915 Klorer
1,178,072 A 4/1916 Hoag
1,190,050 A 7/1916 Verba
1,190,502 A 7/1916 Anderson
1,206,871 A 12/1916 Locke
1,217,838 A 2/1917 Schmidt
1,227,258 A 5/1917 Godley
1,231,635 A 7/1917 Nelson
1,266,399 A 5/1918 Buts
1,286,352 A 12/1918 Kubat
1,290,252 A 1/1919 Lester et al.
1,303,249 A 5/1919 Brown
1,303,345 A 5/1919 McFeaters
1,303,981 A 5/1919 Stafford
1,324,456 A 12/1919 Lutz
1,328,930 A 1/1920 Stern
1,342,626 A 6/1920 Frank
1,345,157 A 6/1920 Francisco
1,346,402 A 7/1920 Glaudel
1,353,552 A 9/1920 Sweet
1,354,873 A 10/1920 Bartley et al.
1,356,213 A 10/1920 Loyd
1,358,159 A 11/1920 Kern
1,358,262 A 11/1920 Sumner
1,358,422 A 11/1920 D'Esopo
1,358,792 A 11/1920 Shogran
1,359,645 A 11/1920 Zink
1,371,703 A 3/1921 Miller
1,372,492 A 3/1921 Doyle
1,373,840 A 4/1921 Smith
1,375,888 A 4/1921 Baer
1,385,485 A 7/1921 Comrie
1,386,565 A 8/1921 Glaudel
1,389,053 A 8/1921 King
1,389,901 A 9/1921 Rosenbluth
1,389,935 A 9/1921 Carroll
1,393,158 A 10/1921 Pawsat
1,393,681 A 10/1921 Glaudel
1,399,461 A 12/1921 Childs
1,401,402 A 12/1921 Hawthorne
1,403,863 A 1/1922 Peat
1,408,834 A 3/1922 Seavey
1,412,690 A 4/1922 Leuckert
1,430,379 A 9/1922 Hubbell
1,434,714 A 11/1922 McMullen
1,435,310 A 11/1922 Kipper
1,441,913 A 1/1923 Darling
1,453,685 A 5/1923 Longenbaugh
1,454,390 A 5/1923 Loranger
1,460,313 A 6/1923 Davis
1,461,289 A 7/1923 Primrose
1,461,398 A 7/1923 McMullen
1,465,213 A 8/1923 Feinberg
1,470,553 A 10/1923 Church
1,488,986 A 4/1924 Hood
1,489,934 A 4/1924 Eklund
1,490,304 A 4/1924 Zink
1,493,609 A 5/1924 Dailey
1,494,033 A 5/1924 Stevens
1,503,357 A 7/1924 Ensign
1,503,638 A 8/1924 Cooper
1,504,767 A 8/1924 Hodny
1,507,094 A 9/1924 Schoenborn
1,512,291 A 10/1924 McGuire
1,515,867 A 11/1924 Masone
1,522,476 A 1/1925 Albright
1,527,998 A 3/1925 Serpico
1,538,340 A 5/1925 Hodny
1,547,794 A 7/1925 Curry
1,558,641 A 10/1925 Short
1,574,899 A 3/1926 Kellogg
1,580,316 A 4/1926 Moreton
1,590,562 A 6/1926 Blonigen
1,597,943 A 8/1926 Wilhelm
1,628,623 A 5/1927 Jonnes
1,706,215 A 3/1929 Davidson
1,721,271 A 7/1929 Du Prel
1,732,534 A 10/1929 Riches
1,735,212 A 11/1929 Pawsat
1,737,214 A 11/1929 Brown
1,745,695 A 2/1930 Hunter
1,793,911 A 2/1931 Dann
1,814,500 A 7/1931 Summerbell
1,835,473 A 12/1931 Davidson
1,849,001 A 3/1932 Fisher
1,936,529 A 6/1932 Taylor
1,932,697 A * 10/1933 Jankovic ..... 248/478
1,941,032 A 12/1933 Knowles
1,989,691 A 2/1935 Hirt
2,010,058 A 8/1935 Carlson
2,038,906 A 4/1936 Ruhland
2,066,699 A 1/1937 Skelton
2,073,089 A 3/1937 Autenrieth
2,074,247 A 3/1937 Armstrong
2,124,006 A 7/1938 Parker
2,163,859 A 6/1939 Ver Bockel
2,177,921 A 10/1939 Zofrey
2,220,429 A 11/1940 Soderberg
2,257,169 A 9/1941 Hopps
2,258,175 A 10/1941 Coleman
2,287,890 A 6/1942 Legassey
2,289,422 A 7/1942 Grotnes
2,290,874 A 7/1942 Graff

(56) References Cited

U.S. PATENT DOCUMENTS

| | | | | |
|---|---|---|---|---|
| 2,315,132 | A | 3/1943 | Powers | |
| 2,331,132 | A | 10/1943 | Nadelson | |
| 2,338,124 | A | 1/1944 | Martinek | |
| 2,360,482 | A | 10/1944 | Evans | |
| 2,365,935 | A | 12/1944 | Boggs | |
| 2,370,748 | A | 3/1945 | O'Donnell | |
| 2,433,550 | A | 12/1947 | Graham | |
| 2,456,505 | A | 12/1948 | Hastings | |
| 2,511,590 | A | 6/1950 | Keck | |
| 2,548,650 | A * | 4/1951 | Brandt | 248/413 |
| 2,596,627 | A | 5/1952 | Wahnish | |
| 2,609,938 | A | 9/1952 | Wells | |
| 2,635,345 | A | 4/1953 | Samborski | |
| 2,651,725 | A | 9/1953 | McFarland | |
| 2,696,996 | A | 12/1954 | Engelhardt | |
| 2,719,691 | A | 10/1955 | Vance | |
| 2,733,035 | A | 1/1956 | Rocheleau | |
| 2,741,497 | A | 4/1956 | Risley | |
| 2,767,003 | A | 10/1956 | Gilmont | |
| 2,783,015 | A | 2/1957 | Kampa | |
| 2,899,772 | A | 8/1959 | Paulsen et al. | |
| 3,026,162 | A | 4/1960 | Waszkiewicz | |
| 2,970,798 | A | 2/1961 | Fritchie et al. | |
| 3,069,189 | A | 12/1962 | Hollaender | |
| 3,081,896 | A | 3/1963 | Hoskins | |
| 3,096,109 | A | 7/1963 | Callahan | |
| 3,113,791 | A | 12/1963 | Frost et al. | |
| 3,118,695 | A | 1/1964 | Engelhardt | |
| 3,126,100 | A | 3/1964 | Christensen | |
| 3,126,191 | A | 3/1964 | Holden | |
| 3,160,349 | A | 12/1964 | Kent | |
| 3,212,713 | A | 10/1965 | Culver | |
| 3,237,899 | A | 3/1966 | Lewis | |
| 3,265,434 | A | 8/1966 | Bolotin | |
| 3,269,683 | A | 8/1966 | Shinaver | |
| D206,198 | S | 11/1966 | Molitor | |
| 3,389,882 | A | 6/1968 | Schlosser | |
| 3,405,587 | A | 10/1968 | Meazzi et al. | |
| 3,484,066 | A | 12/1969 | Aunspaugh | |
| 3,499,679 | A | 3/1970 | Olander | |
| 3,500,594 | A | 3/1970 | O'Brien | |
| 3,581,354 | A | 6/1971 | Usiskin | |
| 3,610,562 | A | 10/1971 | Holmes et al. | |
| 3,640,498 | A | 2/1972 | Aleks | |
| 3,734,439 | A | 5/1973 | Wintz | |
| 3,738,606 | A | 6/1973 | Mille | |
| 3,828,403 | A | 8/1974 | Perrin et al. | |
| 3,837,383 | A | 9/1974 | Ko | |
| 3,843,083 | A | 10/1974 | Angibaud | |
| 3,921,539 | A | 11/1975 | Berger | |
| 4,047,684 | A | 9/1977 | Kobayashi | |
| 4,050,661 | A | 9/1977 | Wooldridge | |
| 4,115,966 | A | 9/1978 | DeLee | |
| 4,126,081 | A | 11/1978 | Zdeb | |
| 4,132,178 | A | 1/1979 | Mueller et al. | |
| 4,162,647 | A | 7/1979 | Aslen | |
| 4,237,798 | A | 12/1980 | Welsch et al. | |
| 4,286,897 | A | 9/1981 | Suskind | |
| 4,307,864 | A | 12/1981 | Benoit | |
| 4,338,875 | A | 7/1982 | Lisowski | |
| 4,443,128 | A | 4/1984 | Yamamoto et al. | |
| 4,452,416 | A | 6/1984 | Templeton | |
| 4,483,334 | A | 11/1984 | Murray | |
| 4,511,158 | A | 4/1985 | Varga et al. | |
| 4,547,092 | A | 10/1985 | Vetter et al. | |
| 4,624,374 | A | 11/1986 | Murtaugh | |
| 4,672,898 | A | 6/1987 | Davidson | |
| 4,729,535 | A | 3/1988 | Frazier et al. | |
| 4,747,569 | A | 5/1988 | Hoshino | |
| 4,799,444 | A | 1/1989 | Lisowski | |
| 4,801,115 | A | 1/1989 | Heard | |
| 4,821,382 | A | 4/1989 | Puschkarski | |
| 4,860,909 | A | 8/1989 | Leumi | |
| 4,884,927 | A | 12/1989 | Menker | |
| 4,892,366 | A | 1/1990 | Yerman | |
| 4,915,418 | A | 4/1990 | Palatchy | |
| 4,917,343 | A * | 4/1990 | Wainscott | 248/447.2 |
| D309,540 | S | 7/1990 | Suttles et al. | |
| 4,953,819 | A | 9/1990 | Davis | |
| 4,964,603 | A | 10/1990 | Yair | |
| 4,967,693 | A * | 11/1990 | Prue | 119/712 |
| 4,976,486 | A | 12/1990 | Rifaat | |
| 5,002,247 | A | 3/1991 | Dispenza et al. | |
| 5,023,755 | A | 6/1991 | Rosenberg | |
| 5,056,854 | A | 10/1991 | Rosen | |
| 5,111,956 | A | 5/1992 | Jow | |
| 5,128,838 | A | 7/1992 | Brandess | |
| D330,555 | S | 10/1992 | Lilly | |
| D332,497 | S | 1/1993 | Shufelt | |
| 5,199,680 | A | 4/1993 | Rivera | |
| D337,462 | S | 7/1993 | LaVaute et al. | |
| 5,259,582 | A | 11/1993 | DeLange | |
| 5,301,999 | A * | 4/1994 | Thompson et al. | 297/184.13 |
| 5,359,866 | A | 11/1994 | Boddy | |
| 5,409,122 | A | 4/1995 | Lazarus | |
| 5,427,344 | A | 6/1995 | Beauchemin | |
| 5,449,138 | A | 9/1995 | Ciancio | |
| 5,509,180 | A | 4/1996 | Benetti et al. | |
| 5,551,660 | A * | 9/1996 | Leduchowski | 248/276.1 |
| 5,566,911 | A | 10/1996 | Hoshino | |
| 5,584,545 | A | 12/1996 | La Vaute et al. | |
| 5,589,903 | A | 12/1996 | Speggiorin | |
| 5,634,619 | A | 6/1997 | Alessi | |
| 5,681,017 | A | 10/1997 | Ciausen | |
| 5,704,232 | A | 1/1998 | Kuo | |
| 5,735,499 | A * | 4/1998 | Phillips et al. | 248/230.1 |
| 5,746,334 | A | 5/1998 | Brandenberg | |
| 5,775,652 | A | 7/1998 | Crawshaw et al. | |
| 5,782,743 | A | 7/1998 | Russell | |
| 5,791,609 | A * | 8/1998 | Hankins | 248/124.1 |
| 5,819,378 | A | 10/1998 | Doyle | |
| 5,826,850 | A | 10/1998 | Goldsmith | |
| 5,964,052 | A | 10/1999 | Jepsen et al. | |
| 5,964,439 | A * | 10/1999 | Johnson | 248/278.1 |
| 5,974,984 | A | 11/1999 | Mitjans | |
| 6,061,939 | A | 5/2000 | Gildea | |
| 6,093,878 | A * | 7/2000 | Hoshino | 84/421 |
| 6,132,018 | A * | 10/2000 | McGrath | 312/140.4 |
| 6,189,459 | B1 | 2/2001 | DeAngelis | |
| 6,209,835 | B1 * | 4/2001 | Walrath et al. | 248/276.1 |
| 6,274,797 | B1 * | 8/2001 | Liao | 84/421 |
| 6,293,035 | B1 | 9/2001 | LaPointe | |
| 6,328,269 | B1 | 12/2001 | Krautloher | |
| 6,390,424 | B1 * | 5/2002 | Kidushim et al. | 248/122.1 |
| 6,523,230 | B1 | 2/2003 | Weinhold | |
| 6,554,238 | B1 | 4/2003 | Hibberd | |
| 6,588,863 | B1 * | 7/2003 | Yatchak et al. | 312/140.4 |
| 6,601,328 | B1 | 8/2003 | Benaquista et al. | |
| 6,631,876 | B1 | 10/2003 | Phillips | |
| 7,261,263 | B2 | 8/2007 | Baker et al. | |
| 8,302,919 | B1 * | 11/2012 | McGrath | 248/205.1 |
| 8,403,430 | B2 | 3/2013 | Atkins | |
| 2003/0057810 | A1 * | 3/2003 | DeWitt | 312/140 |
| 2004/0202506 | A1 * | 10/2004 | Lazic et al. | 403/97 |
| 2004/0226903 | A1 | 11/2004 | Wang | |
| 2005/0097802 | A1 | 5/2005 | Kim | |
| 2005/0251940 | A1 | 11/2005 | Black | |
| 2006/0102818 | A1 * | 5/2006 | Carnevali | 248/278.1 |
| 2007/0177754 | A1 | 8/2007 | Kemmerer | |
| 2007/0200036 | A1 * | 8/2007 | Hsieh | 248/122.1 |
| 2007/0236112 | A1 * | 10/2007 | Williman | 312/140.4 |
| 2008/0029661 | A1 | 2/2008 | Chen | |
| 2008/0164395 | A1 * | 7/2008 | Chang et al. | 248/276.1 |
| 2009/0084019 | A1 | 4/2009 | Carnevali | |
| 2009/0224122 | A1 | 9/2009 | Liao | |
| 2011/0079692 | A1 | 4/2011 | Li | |

OTHER PUBLICATIONS

2-D Adjustable Sneezeguard Brochure, downloaded on or before Oct. 9, 2007, 2 pages.

Ambassador Angled Divider Specifications, downloaded on or before Oct. 9, 2007, 2 pages.

(56) References Cited

OTHER PUBLICATIONS

Ambassador Angled Stationary Sneezeguard Specifications, downloaded on or before Oct. 9, 2007, 2 pages.
Ambassador Vertical Divider Specifications, downloaded on or before Oct. 9, 2007, 2 pages.
Ambassador Vertical Stationary Sneezeguard Specifications, downloaded on or before Oct. 9, 2007, 2 pages.
Angled Divider Stationary Sneezeguard Specifications, downloaded on or before Oct. 9, 2007, 2 pages.
Brochure: Brass Smith, Inc.: A Guide to the Design and Use of the Decorative, User-Friendly Food Guard, Apr. 1998, 13 pages.
Canadian Display Systems Inc., http://www.canadiandisplaysystems.com, downloaded Oct. 5, 2007, 2 pages.
Canadian Display Systems Inc., Portable Sneezeguard—PSG 19, Specifications, downloaded Jun. 1, 2005, 2 pages.
Carlisle Food Service Products, Price List, downloaded 2006, 2 pages.
Carousel Sneezeguard Specifications, downloaded on or before Oct. 9, 2007, 2 pages.
Custom Sneezeguard Form, downloaded on or before Oct. 9, 2007, 1 page.
Declaration of Alan Levine, Case No. 07-CV-01778-MSK, Oct. 5, 2007, 4 pages.
Declaration of Michael Vogel, Case No. 07-CV-01778-MSK, Oct. 5, 2007, 2 pages.
Defendant Lawrence Metal Products, Inc.'s Response to Brass Smith's Implicit Request for Preliminary Injunction, Case No. 07-CV-01778-MSK-BNB, filed Oct. 8, 2007, 14 pages.
Document: Deco-Tech Model Deco-900, Adjustable Vertical Display Spec, Jun. 1, 2003, 1 page.
Document: Vieler International Bistro 1, downloaded on or before Oct. 9, 2007, 1 page.
Flexaguard Portable Sneeze Guard, http://www.flexaguard.com/index.html., downloaded on or before Oct. 5, 2007, 2 pages.
Flexaguard Portable Sneeze Guard, Specifications and http://www.flexaguard.comispee.html. downloaded on or before Oct. 5, 2007, 3 pages.
Folding Portable Sneezeguard Installation Brochure and Specification, four pages, downloaded on or before Oct. 9, 2007, 4 pages.
Front Mount Stationary Sneezeguard Brochure, downloaded on or before Oct. 9, 2007, 2 pages.
Kevry Corporation Brochure, Deco 900 Fully Adjustable, General Specifications, downloaded 2007, 4 pages.
Low Profile Folding Portable Sneezeguard Installation Brochure, downloaded on or before Oct. 9, 2007, 2 pages.
High-Profile Folding Portable Sneezeguard Brochure, downloaded on or before Oct. 9, 2007, 2 pages.
Maintenance Solutions Brochure, downloaded on or before Oct. 9, 2007, 1 page.
Mid-Mount Stationary SneezeQuard Specifications, downloaded on or before Oct. 9, 2007, 2 pages.
Notice of Filing Corrected Exhibit G to Defendant Lawrence Metal Products, Inc.'s Response to Brass Smith's Implicit Request for Preliminary Injunction, Case No. 07-CV-01778-MSK-BNB, filed Oct. 9, 2007, 2 pages.
Premier Brass, Fast-Guard Online Design and Specification, http://www.premierbrass.com/, downloaded on or before Oct. 9, 2007, 4 pages.
Product Information: Brass Smith, Inc.: Hospitality, Sep. 1999, 13 pages.
Product Information: Food Guard Information, downloaded on or before Oct. 9, 2007, 2 pages.
Product Information: Hafele Multi-Purpose Pole Mount System 5.106-5.107, downloaded on or before Oct. 9, 2007, 2 pages.
Product Information: Ikea 2003 Holidays at Home, 3 pages.
Product Information: Moffat Bulk Food Regeneration Trolley Model VGEN 8 AIR Product Information, downloaded on or before Oct. 9, 2007, 1 page.
Product Information: RHO with pictures, downloaded on or before Oct. 9, 2007, 7 pages.
Product Information: Unic Camionnette Dec. 16, 2003, 1 page.
QBD Modular Systems Inc., Sneezeguard Kits Brochure, downloaded on or before Oct. 9, 2007, 2 pages.
Sampler SneezeGuard Brochure, downloaded on or before Oct. 9, 2007, 3 pages.
Serpentine Sneezeguard Specifications, downloaded on or before Oct. 9, 2007, 2 pages.
Sneezequard Accessories Brochure, downloaded on or before Oct. 9, 2007, 2 pages.
Sneezeguard Replacement Hardware Brochure, downloaded on or before Oct. 9, 2007, 2 pages.
Sneezeguard Replacement Stands Brochure, downloaded on or before Oct. 9, 2007, 4 pages.
Sneezeguards Specifications: B-445, downloaded on or before Oct. 9, 2007, 2 pages.
Specification Sheet: Moffat Range of Gantrise 6/2 Issue 5, downloaded on or before Oct. 9, 2007, 1 page.
Specifications: Kevry Deco-Tech Self-Serve Food Shield Portable Rev. 2.3 DEC0-270, -271,-272,-273 May 2002, 5 pages.
Storcart Accessories Brochure, downloaded on or before Oct. 9, 2007, 2 pages.
Storcases Brochure, downloaded on or before Oct. 9, 2007, 2 pages.
The Sneezeguard Storcart Specifications, downloaded on or before Oct. 9, 2007, 2 pages.
Vertical Divider Stationary Sneezeguard Specifications, downloaded on or before Oct. 9, 2007, 2 pages.
Vollarth Co., Product Information: Signature Server, Access Breath Guard, downloaded on or before Oct. 9, 2007, 1 page.
Wall Storaqe Units Specifications, downloaded on or before Oct. 9, 2007, 2 pages.
Website printout: Bernstein Display: Bravo (www.bernsteindisplay.com) Dec. 21, 2003, 6 pages.
Website printout: Forms+ Surfaces: Silhouette Railing System, Profile One Information System (www.forms-surfaces.com), Dec. 21, 2003, 5 pages.
Website printout: Ikea: Stolmen Mounting Fitting (www.ikea.com.au), Nov. 9, 2003, 1 page.
Website printout: Kevry Catalog Products (www.kevry.com) 2003, 3 pages.
Website printout: RHO (www.rho.ca), Dec. 21, 2003, 3 pages.
Website printout: visplaybeam.com, Gallery Dec. 21, 2003, 6 pages.
Website printout: Visual Store: Illico pole, profile one (www.visualstore.com) Dec. 21, 2003, 3 pages.
Website printout:, CafeProducts.com Food Shields-Sneeze Guards. The Safari Adapta Food Shields, Aug. 16, 2003, 1 page.

* cited by examiner

ADJUSTABLE FOOD SHIELD

CROSS REFERENCE TO RELATED APPLICATIONS

This application is a divisional of U.S. patent application Ser. No. 13/022,387, filed Feb. 7, 2011, the complete disclosure of which is herein incorporated by reference.

BACKGROUND OF THE INVENTION

Food shields, also sometimes called sneeze guards, are used in a variety of settings. Typically, a clear panel is suspended over a buffet, smorgasbord, salad bar, retail display, or other kind of food display to protect the food from falling debris or other contamination. One or more panels may also be placed between the displayed food and customers, such that the customers must reach under the food shield to have access to the food, and the opportunities for contamination are limited.

Various health and safety codes may specify the required position of the food shield in relation to the food display. Because food shields are used in many different locations, it is desirable that a food shield be easily adjustable, so that it can be adapted to different spaces and uses. Some prior food shields are described in U.S. Pat. No. 6,588,863 to Yatchak et al., issued Jul. 8, 2003 and titled "Sneeze Guards and Methods for Their Construction", the entire disclosure of which is hereby incorporated herein by reference for all purposes. While the sneeze guards described in that patent have proven very useful, even more adjustability and configurability are desirable. Other prior food shields are described in co-pending U.S. patent application Ser. No. 12/687,039 of Padden et al., filed Jan. 13, 2010 and titled "Food Shield", the entire disclosure of which is hereby incorporated herein by reference for all purposes.

BRIEF SUMMARY OF THE INVENTION

Embodiments of the invention provide a food shield with extensive adjustability and configurability.

According to one aspect, an adjustable food shield comprises at least one post having a longitudinal axis defining a length, and a carrier coupled to the post. The carrier includes a carrier clamping mechanism that is loosenable to enable the carrier to be moved along at least a portion of the length of the post, and is also tightenable to fix the carrier at a certain location on the post. The adjustable food shield further comprises a link having a proximal end pivotally coupled to the carrier such that the link is rotatable with respect to the carrier about an axis that is defined by the pivotal coupling of the carrier and the link, the link also having a distal end, and an arm pivotally coupled to the distal end of the link and extending from the link such that the arm is rotatable with respect to the link about an axis defined by the pivotal coupling of the arm and the link. The adjustable food shield also includes a clear panel coupled to the arm, and the clear panel is movable to different positions by rotating the link, the arm, or both. In some embodiments, the axis defined by the pivotal coupling of the carrier and the link is transverse to the longitudinal axis of the post. In some embodiments, the carrier defines a passage through which the post passes, and the clamping mechanism comprises a nut that defines a passage thorough which the post passes and that threadably engages with the carrier, and a sleeve that also defines a passage through which the post passes and that engages the carrier and the nut such that the sleeve engages the post more tightly as the nut is turned in a first direction, and the sleeve engages the post less tightly as the nut is turned in a second direction opposite the first direction. The sleeve may include a wedge portion that converts relative motion of the carrier and the nut to a clamping motion of the sleeve against the post. In some embodiments, the adjustable food shield further comprises a link fixing mechanism that is actuatable to fix the link in relation to the carrier and is also actuatable to enable rotation of the link with respect to the carrier. The link fixing mechanism may include a knob with a threaded stud, the threaded stud passing through the link and engaging a threaded hole in the carrier. In some embodiments, the adjustable food shield further comprises detent features that define a set of preferred rotational positions of the link in relation to the carrier. The detent features may comprise a set of radial ribs on one of the carrier or the link, each of the radial ribs aligned substantially perpendicular to the axis about which the carrier and the link relatively rotate, and a set of radial slots on the other of the carrier or the link, the radial slots of a size and position to complementarily engage the radial ribs in the preferred rotational positions. In some embodiments, the adjustable food shield further comprises an arm fixing mechanism that is actuatable to fix the arm in relation to the link and is also actuatable to enable rotation of the arm with respect to the link. The arm fixing mechanism may include a knob with a threaded stud, the threaded stud passing through one of the link or the arm and engaging a threaded hole in the other of the link or the arm. In some embodiments, the adjustable food shield further comprises detent features that define a set of preferred rotational positions of the arm in relation to the link. The detent features may comprise a set of radial ribs on one of the link or the arm, each of the radial ribs aligned substantially perpendicular to the axis about which the link and the arm relatively rotate, and a set of radial slots on the other of the link or the arm, the radial slots of a size and position to complementarily engage the radial ribs in the preferred rotational positions. In some embodiments, the arm defines two holes through which threaded fasteners pass to couple the clear panel to the arm, and the adjustable food shield further comprises two caps, each cap having a shank and an enlarged head, wherein the clear panel is disposed between the heads and the arm and is drawn toward the arm by the threaded fasteners. Each cap shank may include a flattened portion that engages a flat-sided hole to prevent rotation of the caps by the threaded fasteners. The longitudinal axis of the post may be substantially vertical. The longitudinal axis of the post may be substantially horizontal.

In some embodiments, the post is a first post, the carrier is a first carrier, the link is a first link, and the arm is a first arm, and the adjustable food shield further comprises a second post displaced from the first; a second carrier coupled to the second post, the second carrier including a carrier clamping mechanism, wherein the carrier clamping mechanism is loosenable to enable the second carrier to be moved along at least a portion of the length of the second post, and the carrier clamping mechanism is also tightenable to fix the second carrier at a certain location on the second post; a second link having a proximal end pivotally coupled to the second carrier such that the second link is rotatable with respect to the second carrier about an axis that is defined by the pivotal coupling of the second carrier and the second link, the second link also having a distal end; and a second arm pivotally coupled to the distal end of the second link and extending from the second link such that the second arm is rotatable with respect to the second link about an axis defined by the pivotal coupling of the second arm and the second link; wherein the clear panel is also coupled to the second arm.

In some embodiments, the carrier is a first carrier, the link is a first link, the arm is a first arm, and the clear panel is a first panel, and the adjustable food shield further comprises a second carrier coupled to the post, the second carrier including a carrier clamping mechanism, wherein the carrier clamping mechanism is loosenable to enable the second carrier to be moved along at least a portion of the length of the post, and the carrier clamping mechanism is also tightenable to fix the second carrier at a certain location on the post; a second link having a proximal end pivotally coupled to the second carrier such that the second link is rotatable with respect to the second carrier about an axis that is defined by the pivotal coupling of the second carrier and the second link, the second link also having a distal end; a second arm pivotally coupled to the distal end of the second link and extending from the second link such that the second arm is rotatable with respect to the second link about an axis defined by the pivotal coupling of the second arm and the second link; and a second panel coupled to the second arm. In some embodiments, the first carrier and link are comprised in a first panel mounting assembly, and the second carrier and link are comprised in a second panel mounting assembly like the first, and the second carrier is inverted with respect to the first carrier. In some embodiments, the first carrier and link are comprised in a first panel mounting assembly, and the second carrier and link are comprised in a second panel mounting assembly like the first, and the axes of rotation of the two links are coincident. In some embodiments, the first carrier and link are comprised in a first panel mounting assembly, and the second carrier and link are comprised in a second panel mounting assembly like the first, and the axes of rotation of the two links intersect.

In some embodiments, the position of the clear panel can be adjusted without the use of tools.

According to another aspect, a method of protecting displayed food items comprises providing a food shield comprising at least one post having a longitudinal axis defining a length, and a carrier coupled to the post. The carrier includes a carrier clamping mechanism that is loosenable to enable the carrier to be moved along at least a portion of the length of the post, and is also tightenable to fix the carrier at a certain location on the post. The food shield further includes a link having a proximal end pivotally coupled to the carrier such that the link is rotatable with respect to the carrier about an axis that is defined by the pivotal coupling of the carrier and the link, the link also having a distal end, and an arm pivotally coupled to the distal end of the link and extending from the link such that the arm is rotatable with respect to the link about an axis defined by the pivotal coupling of the arm and the link; and a clear panel coupled to the arm such that the clear panel is movable to different positions by rotating the link, the arm, or both. The method further comprises rotating the link, the arm, or both to position the clear panel in a certain position such that the clear panel is between the displayed food items and a viewing location. In some embodiments, the method further comprises engaging a link fixing mechanism and an arm fixing mechanism to hold the clear panel in the certain angular position. The method may further comprise adjusting the position of the carrier on the post in conjunction with rotating the link, the arm, or both, to position the clear panel in a combination of a certain angular position and a certain translational location.

According to another aspect, a panel mounting assembly for mounting a panel in a food shield comprises a carrier that defines a passage having a longitudinal axis. The passage is of a shape and size for coupling to a post, and the carrier includes a carrier clamping mechanism that is loosenable to enable the carrier to be moved along at least a portion of the length of the post and is also tightenable to fix the carrier at a certain location on the post. The panel mounting assembly further includes a link having a proximal end pivotally coupled to the carrier such that the link is rotatable with respect to the carrier about an axis that is defined by the pivotal coupling of the carrier and the link, the link also having a distal end, and an arm pivotally coupled to the distal end of the link and extending from the link such that the arm is rotatable with respect to the link about an axis defined by the pivotal coupling of the arm and the link, the arm defining two holes for attaching a panel to the arm. In some embodiments, the axis defined by the pivotal coupling of the carrier and the link is transverse to the longitudinal axis of the passage in the carrier. In some embodiments, the panel mounting assembly is provided in combination with the post and the panel. In some embodiments, the panel mounting assembly further includes a link fixing mechanism that is actuatable to fix the link in relation to the carrier and is also actuatable to enable rotation of the link with respect to the carrier, and an arm fixing mechanism that is actuatable to fix the arm in relation to the link and is also actuatable to enable rotation of the arm with respect to the link. In some embodiments, the panel mounting assembly further includes a first set of detent features that define a set of preferred rotational positions of the link in relation to the carrier, and a second set of detent features that define a set of preferred rotational positions of the arm in relation to the link. The first set of detent features may comprise a set of radial ribs on one of the carrier or the link, each of the radial ribs aligned substantially perpendicular to the axis about which the carrier and the link relatively rotate, and the detent features may further comprise a set of radial slots on the other of the carrier or the link, the radial slots of a size and position to complementarily engage the radial ribs in the preferred rotational positions. The second set of detent features may comprise a set of radial ribs on one of the link or the arm, each of the radial ribs aligned substantially perpendicular to the axis about which the link and the arm relatively rotate, and the detent features may further comprise a set of radial slots on the other of the link or the arm, the radial slots of a size and position to complementarily engage the radial ribs in the preferred rotational positions. In some embodiments, the carrier comprises a flange to which the link couples, the flange being positioned to provide clearance for a second carrier of a second panel mounting assembly like the first to be nested with the panel mounting assembly with the axes of rotation of the links of the two panel mounting assemblies being coincident or intersecting.

According to another aspect, a panel mounting assembly for mounting a panel in a food shield comprises a carrier that defines a passage having a longitudinal axis. The passage is of a shape and size for coupling to a post, and the carrier includes a carrier clamping mechanism that is loosenable to enable the carrier to be moved along at least a portion of the length of the post, and is also tightenable to fix the carrier at a certain location on the post. The panel mounting assembly also includes an arm pivotally coupled to the carrier such that the arm is rotatable with respect to the carrier about an axis defined by the pivotal coupling of the arm and the carrier. The arm includes a set of detent features that are incompatible with detent features included on the carrier, and the arm defines two holes for attaching a panel to the arm. The panel mounting assembly further includes an intermediate member between the arm and the carrier. The intermediate member has a first side including detent features complementary to detent features on the arm, and a second side including detent features complementary to detent features on the carrier. In some embodiments, the panel mounting assembly further includes an arm fixing mechanism that is actuatable to fix the rotational position of the arm in relation to the carrier and is also actuatable to enable rotation of the arm with respect to the carrier.

DETAILED DESCRIPTION OF THE INVENTION

Figure 1:
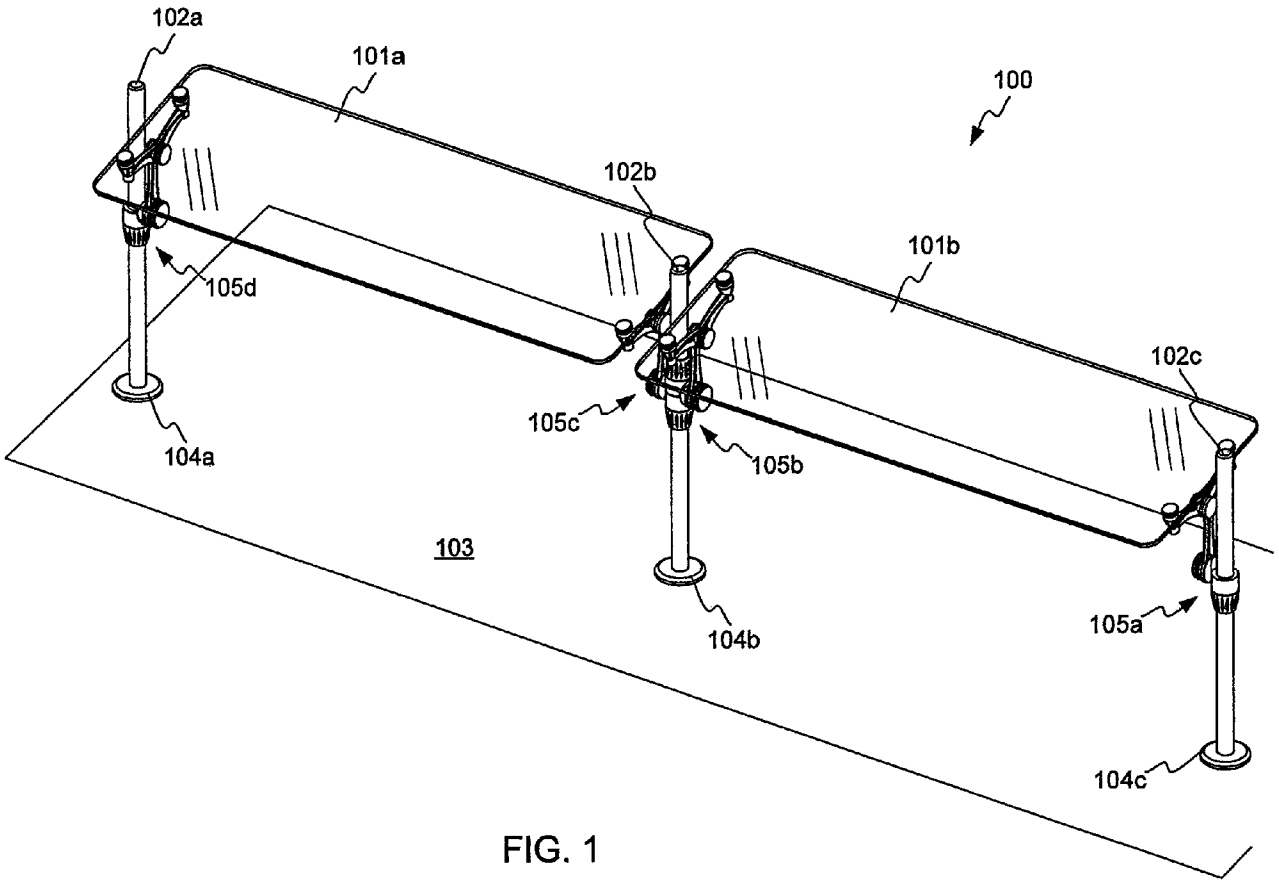
FIG. 1 shows an adjustable food shield in accordance with embodiments of the invention.

FIG. 1 shows an adjustable food shield 100 in accordance with embodiments of the invention. Food shield 100 comprises two panels 101*a* and 101*b*, suspended from posts 102*a*-102*c*. Panels 101*a* and 101*b* may be made, for example, of a clear material such as glass, acrylic, polycarbonate, or another suitable material, such that food or other items may be viewed through the panels. In some applications, an opaque or translucent panel may be used.

Posts 102*a*-102*c* may be round metal tubes of sufficient strength to support panels 101*a* and 101*b*. For example, posts 102*a*-102*c* may be made of steel, aluminum, brass, or anther metal or alloy of metals, or may be made of a suitable non-metallic material. Posts 102*a*-102*c* may be painted, plated, or include other surface finishes for decorative purposes, additional durability, corrosion resistance, or other purposes. Posts 102*a*-102*c* may be affixed to a base 103 by any suitable means, for example by bolts through flanges 104*a*-104*c*. In some embodiments, posts 102*a*-102*c* may be about ¾ inch to about 1.5 inches in diameter, and in some embodiments are nominally 1 inch in diameter. Posts other than circular in cross section may be used in some embodiments.

Panels 101*a*, 101*b* are operably coupled to posts 102*a*-102*c* by panel mounting assemblies 105*a*-105*d*. Panel mounting assemblies 105*a*-105*d* enable panels 101*a* and 101*b* to be fixed in any of a number of positions with respect to posts 102*a*-102*c*. In the exemplary configuration of FIG. 1, panels 101*a* and 101*b* are tilted with respect to base 103, but as will be appreciated, many other panel positions may be achieved. For example, a panel may be mounted horizontally to act as a shelf, or may be mounted vertically to act as a divider. Multiple panels may be suspended between posts 102*a*-102*c*. Larger arrays may be constructed using additional posts, panel mounting assemblies, and panels, as will be explained in greater detail below.

The arrangement of FIG. 1 is but one example of a wide variety of food shield configurations that may be constructed. For example, a food shield may include only a single clear panel suspended between two posts, could include multiple panels suspended between two posts, or could comprise one or more panels coupled to a single post. The panels may be positioned in a wide variety of angular positions and positions along the posts. The lengths of the posts and the height of the panels from a base may be any suitable values. In a typical configuration such as at a salad bar, base 103 may be at countertop height, for example about 32-36 inches from a floor. Posts 102*a*-102*c* may be about 12-28 inches in height, and panels 101*a* and 101*b* may be positioned such that they provide visual access to displayed food, but protect the food from falling debris and incidental contact. For example, a tilted panel may provide convenient visual access and also relatively broad coverage of the displayed food for protection. A customer may reach under the edge of a panel to retrieve food. In some embodiments, the lower panel edge may be about 12 to 18 inches above base 103. Additional panels may be provided, for example horizontal panels above tilted panels 101*a* and 101*b*, to provide additional protection and to provide a place to display items that require less protection. As is explained in more detail below, non-planar panels may be used, for example panels providing both horizontal and angled surfaces, or surfaces at multiple angles. While panels 101*a* and 101*b* are generally rectangular with rounded corners, this is not a requirement. Panels of other shapes may be used as well, for example square, triangular, trapezoidal, oval, round, or other shapes.

The ends of panels 101*a* and 101*b* may encroach quite closely to posts 102*a*-102*c*, for example within 1/16 inch, ⅛ inch, ¼ inch, ½ inch, 1 inch, or another suitable distance. The panels may be of any suitable size, but in some embodiments may be about ⅛ to ⅜ inches in thickness, about 10-14 inches in width, and about 24-40 inches in length. Nearly any panel dimensions may be used, subject to the strength and stiffness of the panel material, the number and spacing of posts, and the available area for the food shield.

In some embodiments, the panels may reside between the posts, as illustrated in FIG. 1, but in some embodiments, the panel mounting assemblies may reach above the posts, and the panels may extend over the tops of the posts, for more complete coverage of the displayed food. Many, many other configurations are possible, some of which are described below.

Figure 2A:
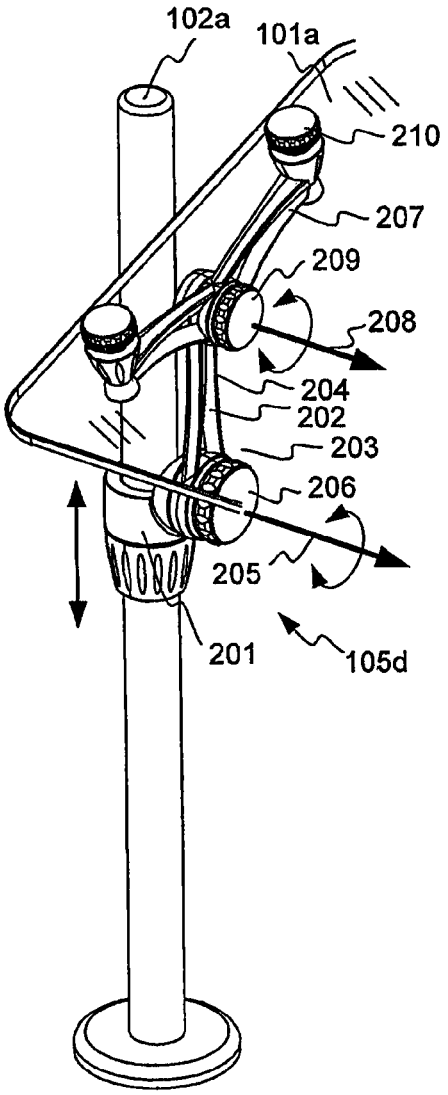
FIGS. 2A and 2B illustrate enlarged views of portions of the adjustable food shield of FIG. 1.
Figure 2B:
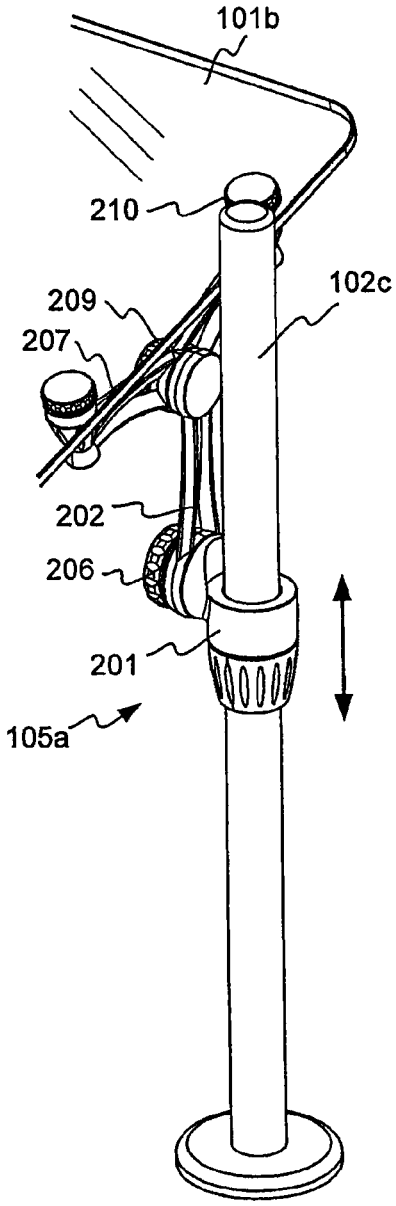

FIGS. 2A and 2B illustrate enlarged views of portions of the adjustable food shield of FIG. 1, illustrating panel mounting assemblies 105*a* and 105*d* in greater detail. Panel mounting assemblies 105*a* and 105*d* are preferably identical, and thus like parts will be assigned like reference numbers. Referring to FIG. 2A, panel mounting assembly 105*d* includes a carrier 201, through which post 102*a* passes. Carrier 201 includes a clamping mechanism that is loosenable to allow the carrier to be moved along the length of its respective post, and is also tightenable to fix the carrier at a certain location on the post. When the clamping mechanism is loosened, carrier 201 may also be rotated around the longitudinal axis of post 102*a*. Additional details of the clamping mechanism are described below. Thus the position of carrier 201 is adjustable along at least a portion of the length of the post. For a vertical post, this movement may enable adjustment of the height of panels 101*a* and 101*b*.

A link 202 has a proximal end 203 and a distal end 204, and is pivotally coupled at proximal end 203 to carrier 201 such that link 202 (and other components mounted to it) is rotatable with respect to carrier 201 about an axis 205, which is defined by the pivotal coupling of carrier 201 and link 202 and is transverse to the longitudinal axis of post 102*b*. A knob 206 can be tightened to fix link 202 with respect to carrier 201, or may be loosened to allow rotation of link 202 with respect to carrier 201, for example to adjust food shield 101 into a different configuration. Preferably, link 202 can rotate through a full 360 degrees about axis 205. An arm 207 is pivotally coupled to distal end 204 of link 202, and can rotate with respect to link 202 about an axis 208. A second knob 209 may be tightened to fix arm 207 to link 202, or may be loosened to allow adjustment of the relative angular positions of arm 207 and link 202.

Panel 101*a* is coupled to arm 207, and thus is moved to different positions by the rotations of link 202, arm 207, or both. In the example of FIG. 2A, panel 101*a* defines mounting holes, and arm 207 defines corresponding through holes. Caps 210 protrude through panel 101*a* and into the corresponding holes in arm 207. A fastener is engaged with the underside of each cap 210 to draw panel 101*a* toward arm 207, so that panel 101*a* is disposed between the enlarged heads of the caps 210 and arm 207. As is shown in more detail below, each cap 210 may also include a shank that further includes a flattened portion that engages a complementary flat side of the hole in arm 207, to prevent cap 210 from turning as the fastener is turned. Other ways of coupling panel 101*a* to arm 207 may be utilized as well. In some embodiments, caps 210 are spaced about 4 to 8 inches apart, and in some embodiment are spaced nominally 6 inches apart, as measured between the centerlines of their shanks.

Figure 3B:
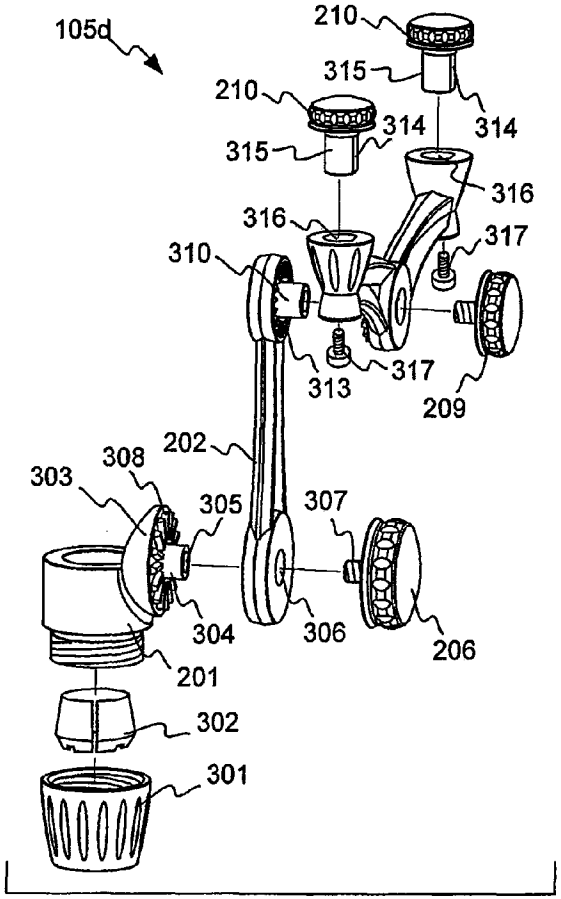
FIGS. 3A and 3B illustrate exploded views of a panel mounting assembly in accordance with embodiments of the invention.
Figure 3A:
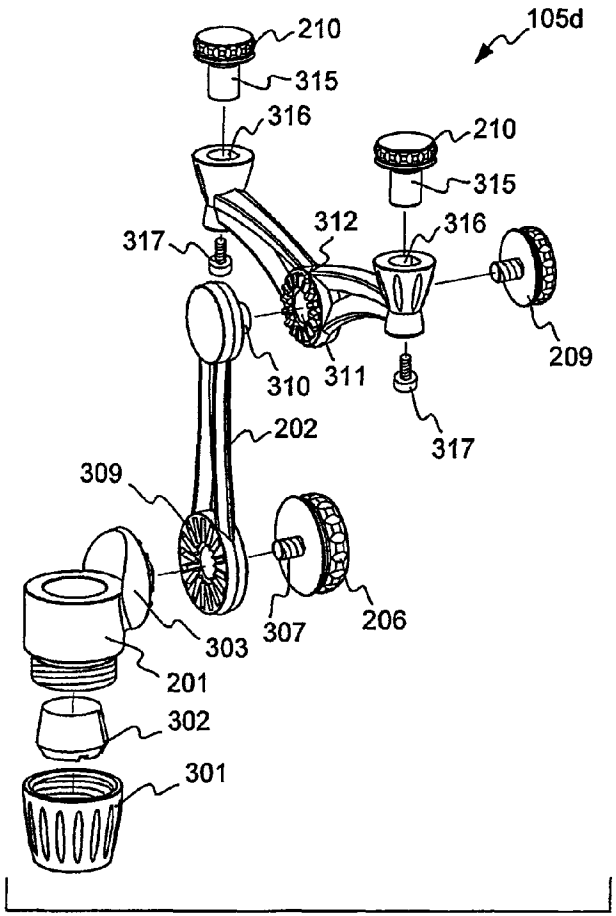

FIGS. 3A and 3B illustrate exploded views of panel mounting assembly 105*d*, and show further details of the operation of the panel mounting assemblies. As is shown in FIGS. 3A and 3B, panel mounting assembly 105*d* further includes a nut 301 that threadably engages with carrier 201. Between carrier 201 and nut 301 is a sleeve 302. Nut 301 and sleeve 302 also define passages through which post 102*a* passes. When nut 301 is turned in a direction that threads nut 301 onto carrier 201, sleeve 302 is compressed so that it more tightly engages post 102*a*. Carrier 201 can thus be fixed in a particular position on rod 102*a* by tightening nut 301. When nut 301 is turned in a direction that results in less engagement between carrier 201 and nut 301, sleeve 302 engages post 102*a* less tightly, and the position of carrier 201 on post 102*a* can be adjusted, or panel mounting assembly 105*d* can be removed from post 102*a*.

Sleeve 302 is preferably made of a material that can withstand repeated compression and decompression, and that will avoid marring of post 102*a*. For example, sleeve 302 may be made of a polymer such a nylon, acetal, polytetrafluorethylene, or another suitable material or combination or blend of materials. Carrier 201 and nut 301 may be made of any suitable material, for example aluminum, zinc, steel, stainless steel, brass, or nonmetallic materials. In some embodiments, carrier 201 and nut 301 are made of die cast aluminum, with threads added by post machining processes. The various parts may be painted, plated, or otherwise coated, for example for decorative purposes, enhanced wear properties, or resistance to corrosion. The parts may be brushed, polished, or given another surface finish.

In the example shown, sleeve 302 includes an angled shape that cooperates with angled surfaces within carrier 201, nut 301, or both to enhance the compression against post 102*a*. In other embodiments, sleeve 302 may be made of an elastomer or other material that is distorted under pressure to compress against post 102*a*.

Carrier 201 includes a flange 303 that includes features for engaging link 202. For example, carrier 201 may include a round boss 304 that defines an axis of rotation for link 202 in relation to carrier 201. Boss 304 may be approximately cylindrical, but may also be tapered, for example to provide draft for facilitating casting or molding of carrier 201 or to facilitate assembly of the panel mounting assembly. Boss 304 may include a threaded hole 305. Link 202 may include a through hole 306 of a complementary shape and size to boss 304, so that link 202 may rotate about the axis defined by boss 304. A knob 206 may be used to fix link 202 and carrier 201. For example, knob 206 may include a threaded stud 307 that engages with threaded hole 305 in carrier 201, so that link 202 may be tightly clamped between knob 206 and carrier 201. Preferably, the height of boss 304 is less than the effective thickness of link 202, to facilitate the clamping effect of knob 206.

Carrier 201 and link 202 may also include detent features that define a set of preferred rotational positions of link 202 in relation to carrier 201. In the example illustrated, carrier 201 has a set of radial ribs 308 disposed around boss 304, each rib 308 oriented substantially orthogonal to the axis defined by boss 304. Link 202 includes a set of complementary slots 309, of a shape, size, and position to engage the radial ribs 308 in the preferred rotational positions. In one embodiment, 16 ribs and 16 slots are provided, angularly spaced 22.5 degrees apart. It will be recognized that more or fewer ribs and slots may be used, providing more closely spaced preferred rotational positions, or more widely spaced preferred rotational positions. The ribs and slots may also be interchanged, if desired, such that ribs 308 reside on link 202, and slots 309 reside on carrier 201.

A similar arrangement may be provided at distal end 204 of link 202, for coupling link 202 to arm 207. For example, link 202 may include a boss 310, and arm 207 may define a mating hole 311, such that boss 310 defines an axis of rotation of arm 207 with respect to link 202. A knob 209 may be used to fix arm 207 and link 202 together, in a manner similar to that described above for fixing link 202 and carrier 201 together. In the example shown, arm 207 includes a set of radial ribs 312, and link 202 defines a complementary set of radial slots 313, defining a set of preferred relative angular positions of arm 207 and link 202. Ribs 312 and slots 313 are an example of detent features.

Preferably, but not necessarily, the detent features defining preferred rotational positions of link 202 and carrier 201 and preferred rotational positions of arm 207 and link 202 define the same number of preferred angular positions, with the same angular spacing. This arrangement facilitates positioning panel 101*a* in nominally exact horizontal and vertical positions. Other kinds of detent features may be used, for example a sawtooth radial pattern of ridges and grooves, pins and holes, or other features. In some embodiments, the preferred angular positions need not be equally spaced. In other embodiments, the system may rely on friction between the mating surfaces of carrier 201, link 202, and arm 207 and the clamping force provided by knobs 206 and 209 to hold the panels in fixed positions. The mating surfaces may be textured or roughened to increase friction.

Preferably, nut 301 and knobs 206 and 209 are actuatable by hand, so that the position of the panel can be adjusted and fixed without the use of tools.

FIGS. 3A and 3B also illustrate caps 210, including flat sides 314 of shanks 315, and complementary flat-sided holes 316 in arm 207 to receive shanks 315. Fasteners such as screws 317 may draw caps 210 toward arm 207, capturing panel 101*a* between caps 210 and arm 207. The flat sides 314 of shanks 315 may serve to prevent rotation of caps 210 as screws 317 are tightened.

Figure 4:
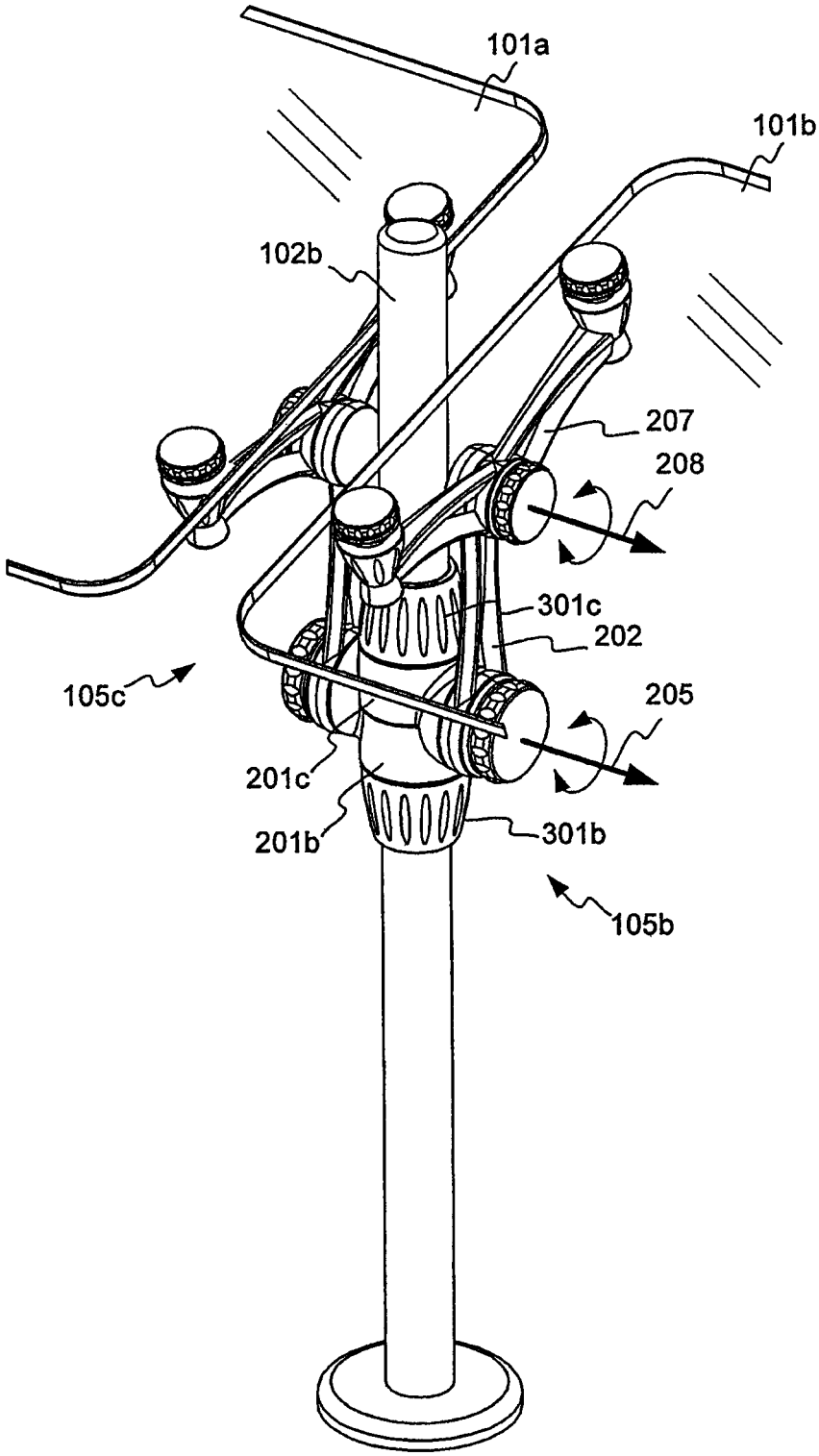
FIG. 4 illustrates an extended food shield having multiple aligned panels coupled to the same post, in accordance with embodiments of the invention.

Using numbers of posts, panels, and panel mounting assemblies, a large variety of food shield configurations may be constructed. For example, an extended food shield having multiple aligned panels can be constructed by coupling adjacent panels to the same post, as illustrated in FIG. 4. In this arrangement, two panel mounting assemblies 105*b* and 105*c* are mounted to post 102*b*. Carrier 201*c* and nut 301*c* (and the corresponding sleeve) panel mounting assemblies 105*c* are inverted with respect to the similar parts 201*b* and 301*b* of panel mounting assembly 105*b*. The positioning of flanges 303 and bosses 304 is such that the carriers can be nested and the rotational axes of links 202 coincide, and multiple panels 101*a* and 101*b* can be mounted and adjusted in alignment with each other. In the arrangement of FIG. 4, panels 101*a* and 101*b* are positioned so that they are coplanar with each other, but this is not a requirement. Either could be positioned at a different angle, or displaced, or both, for example by fixing link 202 at a different rotational position with respect to its carrier 201, or by fixing arm 207 at a different rotational position with respect to link 202, or both.

Figure 5:
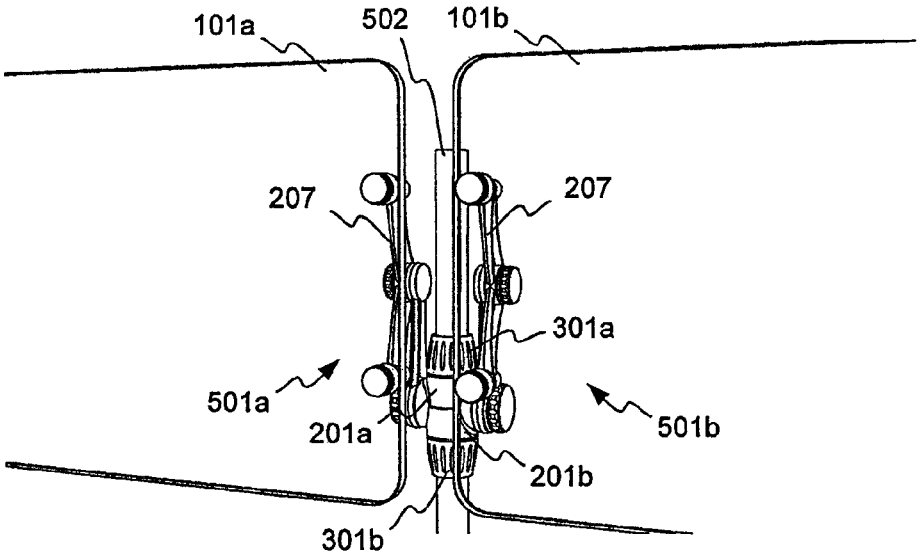
FIG. 5 illustrates another food panel configuration, in accordance with embodiments of the invention.

FIG. 5 illustrates another possible configuration, in which adjacent panels 101*a* and 101*b* are held in a vertical orientation (aligned with the axis of post 102*b*). As in the configuration of FIG. 4, two panel mounting assemblies 501*a* and 501*b* are mounted to the same post 502, by inverting one of the carrier 201*a* and nut 301*a* of panel mounting assembly 501*a* with respect to the other carrier 201*b* and nut 301*b* of panel mounting assembly 501*b*. In this example arrangement, arms 207 are positioned approximately parallel to the axis of post 502.

Figure 6A:
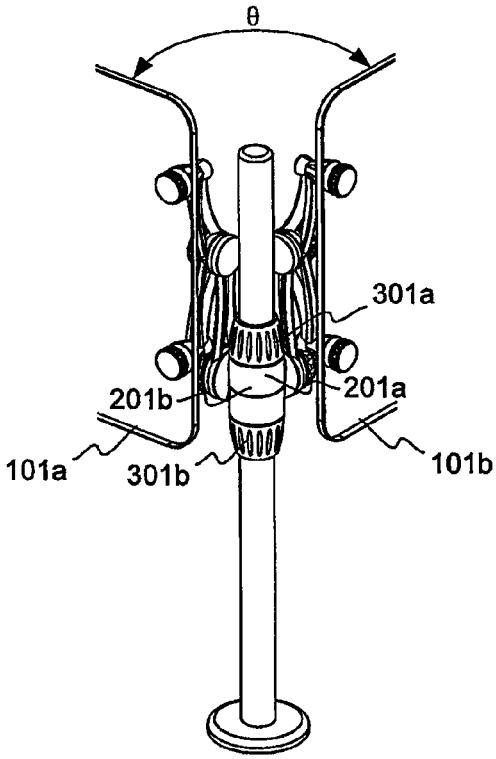
FIG. 6A illustrates a variation of the arrangement shown in FIG. 5.
Figure 6B:
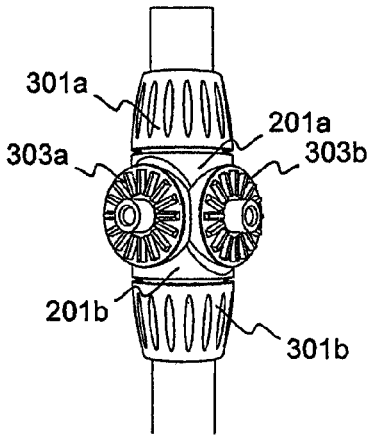
FIG. 6B illustrates a portion of the arrangement of FIG. 6A, from a reverse angle.

FIG. 6A illustrates a variation of the arrangement shown in FIG. 5. In the configuration of FIG. 6A, panels are held in a vertical orientation, and also at right angles to each other. Preferably flanges 303 subtend 90 degrees or less of the circumference of carriers 201, so that when two carriers 201 are inverted and mated together to attach two panels to the same post, the carriers 201 can also rotate about the axis of the post to position the panels in any of a number of angles θ with respect to each other. FIG. 6B illustrates carriers 201*a* and 201*b* and nuts 301*a* and 301*b* of FIG. 6A from a reverse angle, and with the other parts of panel mounting assemblies 601*a* and 601*b* removed. As can be seen, flanges 303*a* and 303*b* abut when the panels 101*a* and 101*b* are at their closest possible approach. In this embodiment, the axes of rotation of the links with respect to the carriers of panel mounting assemblies 601*a* and 601*b* are at the same height, but intersect each other.

A wide variety of other arrangements is possible, using panel mounting assemblies, posts, and panels in combinations, and placing the panel mounting assemblies in different configurations.

Figure 7:
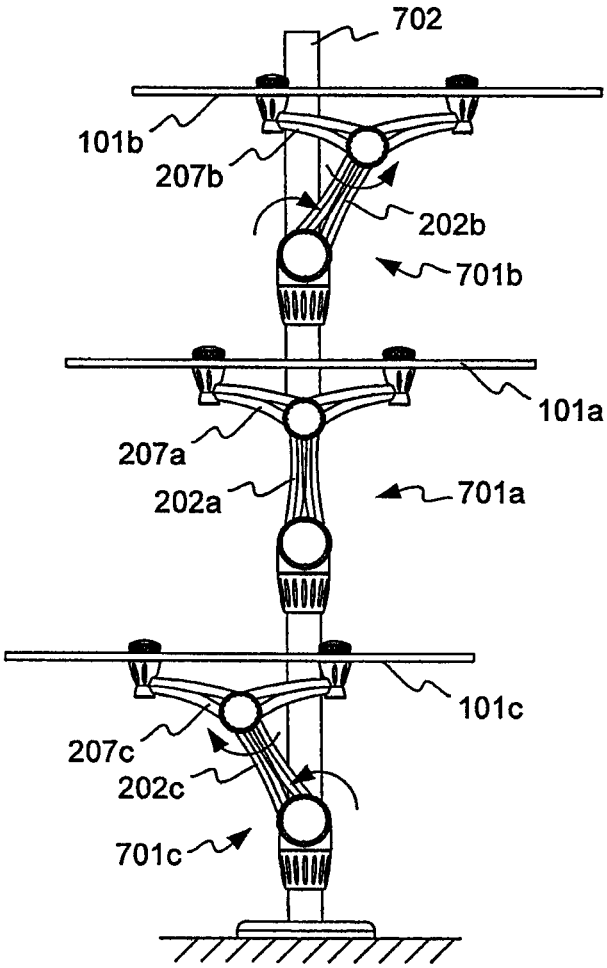
FIG. 7 illustrates in-plane shifting of panels, in accordance with embodiments of the invention.

For example, FIG. 7 illustrates that in-plane shifting of panels can be accomplished by appropriate selections of arm and link rotational positions. Considering panel mounting assembly 701*a* as a reference, panel 101*a* is held in a horizontal orientation, with link 202*a* in a vertical orientation and arm 207*a* fixed perpendicular to link 202*a*. By contrast, link 202*b* of panel mounting assembly 701*b* is fixed in a position that is rotated clockwise in relation to post 702, and arm 207*b* is fixed in a position that is rotated counterclockwise with respect to link 202*b* by an equal amount. Panel 101*b* is thus also held in a horizontal orientation, but is shifted to the right (in this view) as compared with panel 101*a*. Similarly, link 202*c* of panel mounting assembly 701*c* is fixed in a position that is rotated counterclockwise with respect to post 702, and arm 207*c* is fixed in a position that is rotated clockwise with respect to link 202*c*, by an equal mount. Panel 101*c* is thus also held in a horizontal orientation, but is shifted to the left as compared with panel 101*a*.

Figure 8:
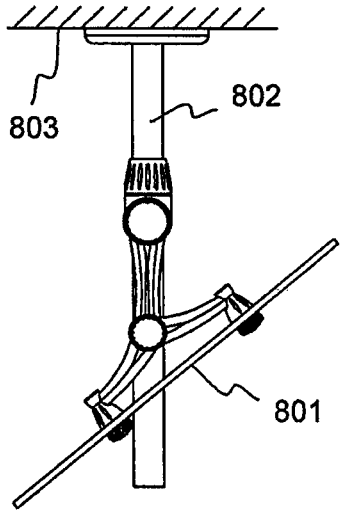
FIG. 8 illustrates another variation, in which a panel is mounted to a post that is suspended from an overhead surface, in accordance with embodiments of the invention.
Figure 9:
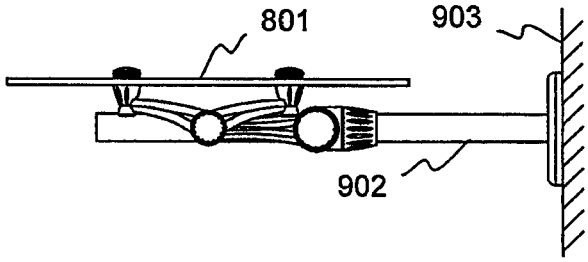
FIG. 9 illustrates an arrangement in which a panel is mounted to a post that is in a horizontal orientation, in accordance with embodiments of the invention.

FIG. 8 illustrates yet another variation, in which a panel 801 is mounted to a post 802 that is suspended from an overhead surface 803, such that panel 801 can be hung from a ceiling or other overhead surface or structure. Similarly, FIG. 9 illustrates an arrangement in which a panel 901 is mounted to a post 902 that is in a horizontal orientation, and is mounted to a vertical surface 903, such as a wall. Panel 901 may extend over post 902 if desired. The panel mounting assemblies in these examples may be further reconfigured if desired.

Figure 10:
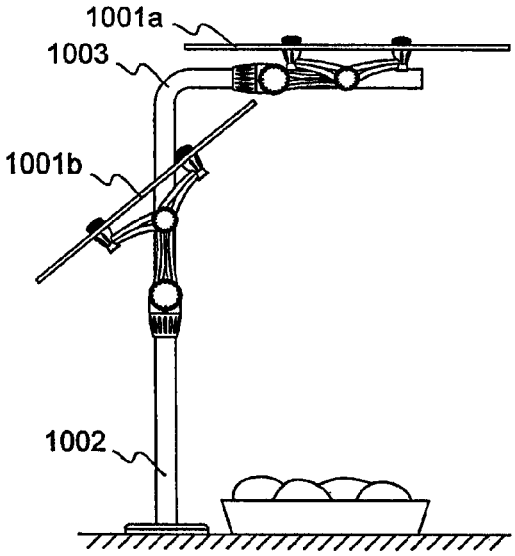
FIG. 10 illustrates another arrangement for an adjustable food shield, in accordance with embodiments of the invention.

FIG. 10 illustrates a configuration in which two panels 1001*a* and 1001*b* are mounted to the same post 1002, but post 1002 includes a bend 1003, such that part of post 1002 is in a vertical orientation, and part of post 1002 is in a horizontal orientation. The arrangement of FIG. 10 may be especially useful for displaying and protecting food or other items that a customer may serve to himself or herself by reaching under panel 1001*b*.

Figure 11:
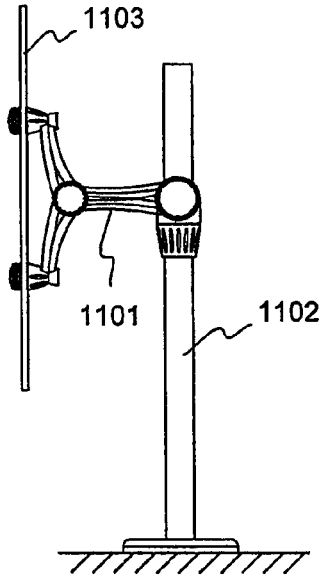
FIG. 11 illustrates another arrangement for an adjustable food shield, in accordance with embodiments of the invention.

FIG. 11 illustrates another configuration, in which a link 1101 is positioned at a right angle to post 1102. Panel 1103 is thus spaced from post 1102 by a considerable distance.

Figure 12:
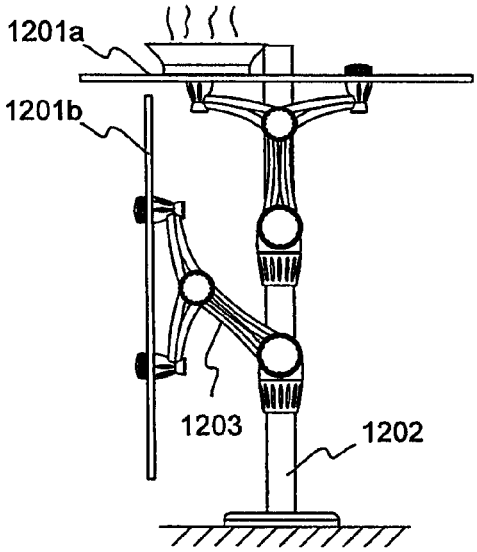
FIG. 12 illustrates still another arrangement for an adjustable food shield, in accordance with embodiments of the invention.

FIG. 12 illustrates yet another possible configuration, in which two panels 1201*a* and 1201*b* are mounted to the same vertical post 1202. Panel 1201*a* is positioned in a horizontal orientation, and panel 1201*b* is positioned in a vertical orientation, and spaced a distance from post 1202 by virtue of the rotated position of link 1203. The arrangement of FIG. 12 may be especially useful for protecting food in a serving area. The area below panel 1201*a* and behind panel 1201*b* is well protected, and panel 1201*a* may function as a shelf on which food may be served to a customer.

Figure 13:
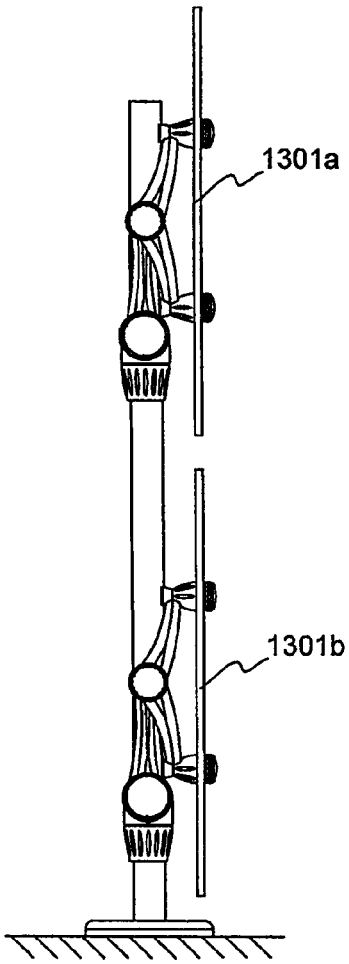
FIG. 13 illustrates yet another arrangement for an adjustable food shield, in accordance with embodiments of the invention.

FIG. 13 illustrates another possible arrangement, in which two panels 1301*a* and 1301*b* are positioned vertically to form a divider.

Figure 14:
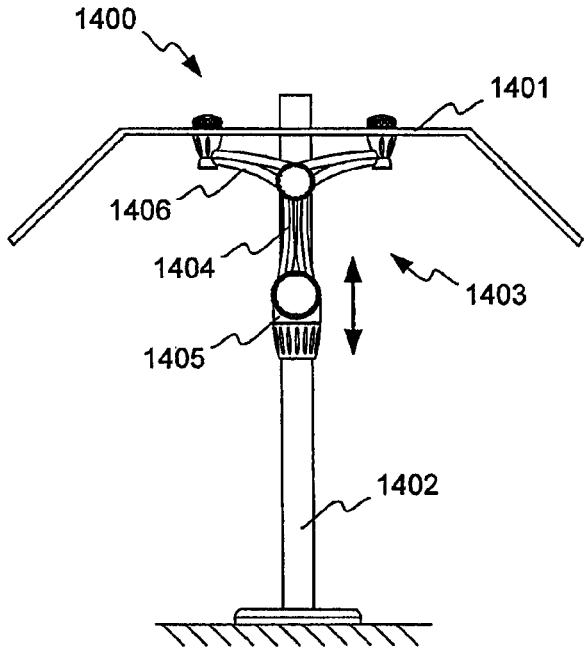
FIG. 14 illustrates an adjustable food shield having a non-planar panel, in accordance with embodiments of the invention.

While the panels illustrated thus far have been substantially planar, this is not a requirement. FIG. 14 illustrates a food shield 1400 having a non-planar panel 1401 mounted to post 1402 using a panel mounting assembly 1403 according to embodiments of the invention. As in any of the illustrated embodiments, panel 1401 is adjustable to a wide variety of positions by repositioning link 1404 with respect to carrier 1405, repositioning arm 1406 with respect to link 1404, or both. Also as in any of the illustrated embodiments, panel mounting assembly 1403 can be repositioned along post 1402.

Figure 15:
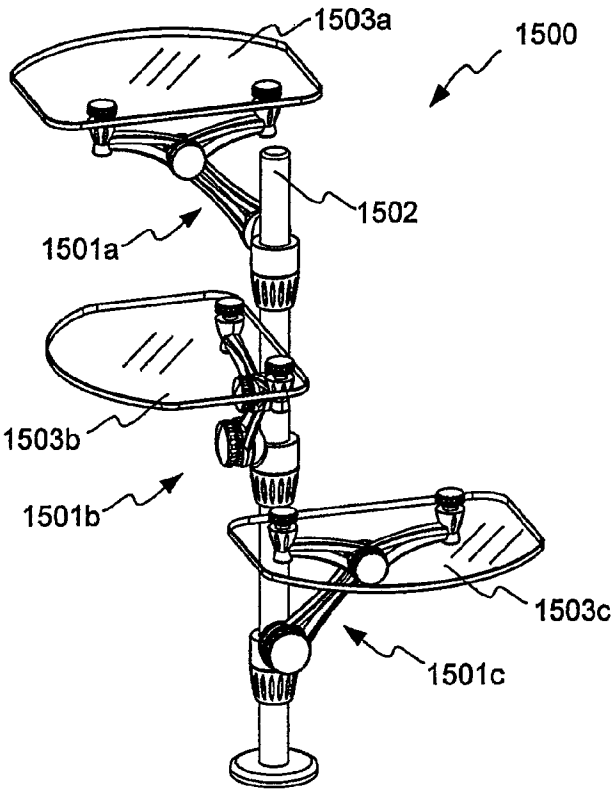
FIG. 15 illustrates a display stand, in accordance with embodiments of the invention.

FIG. 15 illustrates another kind of structure that may be constructed of components in accordance with embodiments of the invention. Display stand 1500 may be useful for displaying food or other items. In display stand 1500, three panel mounting assemblies 1501*a*-1501*c* are positioned on a single post 1502. Each supports a respective panel 1503*a*-1503*c*. The panels may conveniently be used as shelves for displaying desserts and the like. The positions of the panels are adjustable as described above. Exemplary display stand 1500 illustrates the use of a single post 1502 to support one or more panels, the use of non-rectangular panels 1503*a*-1503*c*, and the ability of panel mounting assemblies 1501*a*-1501*c* to be placed in various rotational positions about the axis of post 1502.

Figure 16:
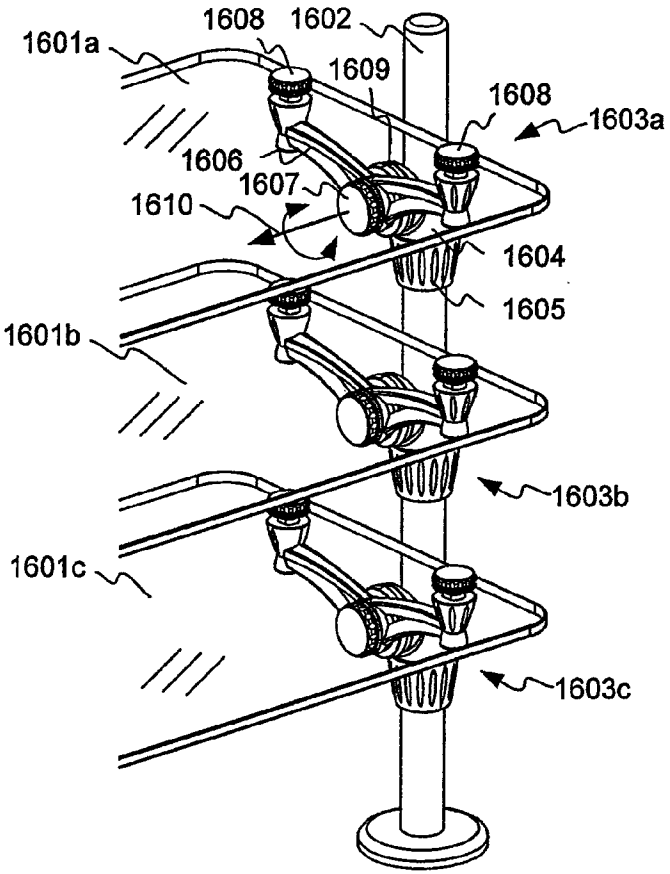
FIG. 16 illustrates another food shield variation, in accordance with embodiments of the invention.

FIG. 16 illustrates another variation, which may be especially useful in arrangements where it is desired that panels be spaced closely to each other. In FIG. 16, three panels 1601*a*, 1601*b*, and 1601*c* are mounted to post 1602 using panel mounting assemblies 1603*a*, 1603*b*, and 1603*c*. Panel mounting assemblies 1603*a-c* utilize some parts in common with the panel mounting assemblies previously described, including carrier 1604, nut 1605, arm 1606, knob 1607, and caps 1608. However, panel mounting assemblies 1603*a-c* lack the links shown in the previously-described panel mounting assemblies.

Each panel mounting assembly 1603*a-c* includes a reducer 1609, which is an intermediate member that enables arm 1606 to couple to carrier 1604. Each arm 1606 and its associated panel can still be fixed in various rotational positions about an axis 1610. Reducer 1609 has detent features on both sides, complementary to the detent features on carrier 1604 on one side, and complementary to the detent features on arm 1606 on the other.

Figure 17A:
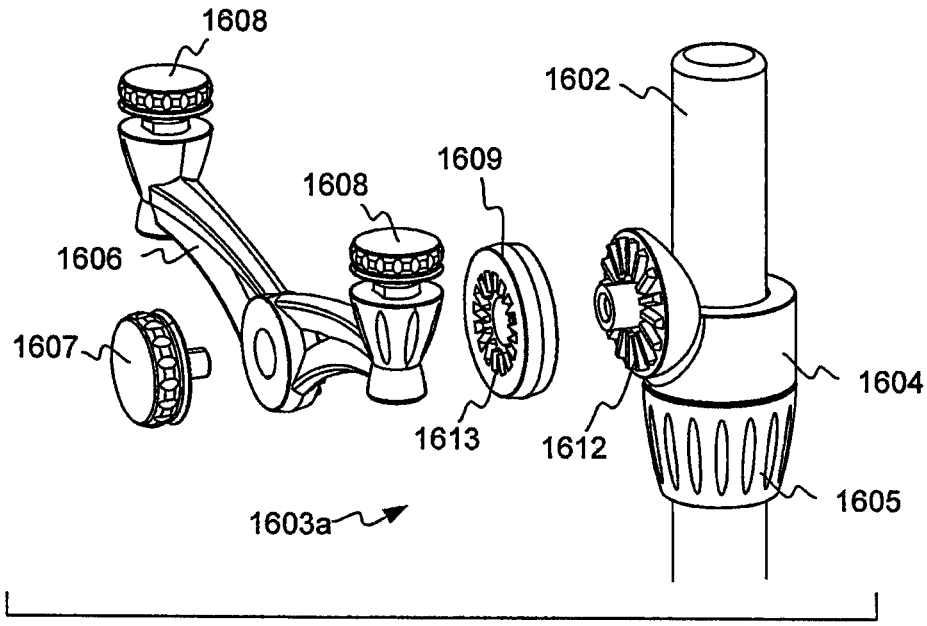
FIGS. 17A and 17B illustrate exploded views of a panel mounting assembly in accordance with embodiments of the invention.
Figure 17B:
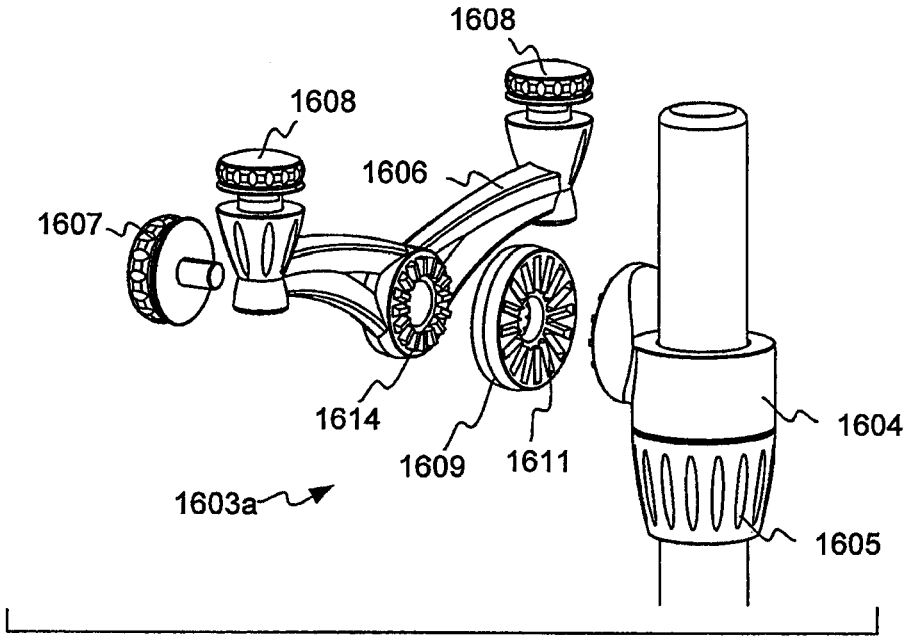

FIGS. 17A and 17B illustrate front and rear exploded views of panel mounting assembly 1603*a*. Slots 1611, on the side of reducer 1609 that engages with carrier 1604, are complementary to ribs 1612 on carrier 1604. Similarly, slots 1613 on the other side of carrier 1604 are complementary to ribs 1614 on arm 1606. The slots and ribs engage to provide detents at preferred angular locations of arm 1606 with respect to carrier 1604. In this embodiment, the detent features of carrier 1604 and arm 1606 are not compatible, so arm 1606 cannot be conveniently directly coupled to carrier 1604. Reducer 1609 thus enables coupling of arm 1606 to carrier 1604 without a link member.

In other aspects, the operation of panel mounting assembly 1603*a* is similar to the operation of the panel mounting assemblies previously described. Knob 1607 includes a threaded stud that engages with a threaded hole in carrier 1604, to fix arm 1606 in position. Nut 1605 is actuatable to tighten or loosen carrier 1604 on post 1602, to enable adjustability of the position of panel mounting assembly 1603*a* on post 1602.

The invention has now been described in detail for the purposes of clarity and understanding. However, those skilled in the art will appreciate that certain changes and modifications may be practiced within the scope of the appended claims.

What is claimed is:

1. An adjustable food shield, comprising:

at least one post having a longitudinal axis defining a length;

a carrier coupled to the post, the carrier including a carrier clamping mechanism, wherein the carrier clamping mechanism is loosenable to enable the carrier to be moved along at least a portion of the length of the post, and the carrier clamping mechanism is also tightenable to fix the carrier at a certain location on the post;

a link having a proximal end pivotally coupled to the carrier such that the link is rotatable with respect to the carrier about an axis that is defined by the pivotal coupling of the carrier and the link, the link also having a distal end;

an arm pivotally coupled to the distal end of the link and extending from the link such that the arm is rotatable with respect to the link about an axis defined by the pivotal coupling of the arm and the link; and a clear panel coupled to the arm such that the clear panel is movable to different positions by rotating the link, the arm, or both, wherein the link and panel are configured such that when the post is vertically oriented relative to a horizontal surface and food is positioned behind a rear side of the post, the panel is movable forward of a front side of the post, with the distal end of the link being completely forward of the front side of the post, thereby permitting the post to be positioned closer to the food while still permitting the panel to be forward of the food by a specified distance.

2. The adjustable food shield of claim 1, wherein the axis defined by the pivotal coupling of the carrier and the link is transverse to the longitudinal axis of the post.

3. The adjustable food shield of claim 1, wherein the carrier defines a passage through which the post passes, and wherein the clamping mechanism comprises:

a nut that defines a passage through which the post passes and that threadably engages with the carrier; and a sleeve that also defines a passage through which the post passes and that engages the carrier and the nut such that the sleeve engages the post more tightly as the nut is turned in a first direction, and the sleeve engages the post less tightly as the nut is turned in a second direction opposite the first direction.

4. The adjustable food shield of claim 3, wherein the sleeve includes a wedge portion that converts relative motion of the carrier and the nut to a clamping motion of the sleeve against the post.

5. The adjustable food shield of claim 1, further comprising a link fixing mechanism that is actuatable to fix the link in relation to the carrier and is also actuatable to enable rotation of the link with respect to the carrier.

6. The adjustable food shield of claim 5, wherein the link fixing mechanism includes a knob with a threaded stud, the threaded stud passing through the link and engaging a threaded hole in the carrier.

7. The adjustable food shield of claim 1, further comprising detent features that define a set of preferred rotational positions of the link in relation to the carrier.

8. The adjustable food shield of claim 7, wherein the detent features comprise a set of radial ribs on one of the carrier or the link, each of the radial ribs aligned substantially perpendicular to the axis about which the carrier and the link relatively rotate, and wherein the detent features further comprise a set of radial slots on the other of the carrier or the link, the radial slots of a size and position to complementarily engage the radial ribs in the preferred rotational positions.

9. The adjustable food shield of claim 1, further comprising an arm fixing mechanism that is actuatable to fix the arm in relation to the link and is also actuatable to enable rotation of the arm with respect to the link.

10. The adjustable food shield of claim 9, wherein the arm fixing mechanism includes a knob with a threaded stud, the threaded stud passing through one of the link or the arm and engaging a threaded hole in the other of the link or the arm.

11. The adjustable food shield of claim 1, further comprising detent features that define a set of preferred rotational positions of the arm in relation to the link.

12. The adjustable food shield of claim 11, wherein the detent features comprise a set of radial ribs on one of the link or the arm, each of the radial ribs aligned substantially perpendicular to the axis about which the link and the arm relatively rotate, and wherein the detent features further comprise a set of radial slots on the other of the link or the arm, the radial slots of a size and position to complementarily engage the radial ribs in the preferred rotational positions.

13. The adjustable food shield of claim 1, wherein the arm defines two holes through which threaded fasteners pass to couple the clear panel to the arm, and wherein the adjustable food shield further comprises two caps, each cap having a shank and an enlarged head, wherein the clear panel is disposed between the heads and the arm and is drawn toward the arm by the threaded fasteners.

14. The adjustable food shield of claim 13, wherein in each cap shank includes a flattened portion that engages a flat-sided hole to prevent rotation of the caps by the threaded fasteners.

15. The adjustable food shield of claim 1, wherein the longitudinal axis of the post is substantially vertical.

16. The adjustable food shield of claim 1, wherein the longitudinal axis of the post is substantially horizontal.

17. The adjustable food shield of claim 1, wherein the post is a first post, the carrier is a first carrier, the link is a first link, and the arm is a first arm, the adjustable food shield further comprising:

a second post displaced from the first;

a second carrier coupled to the second post, the second carrier including a carrier clamping mechanism, wherein the carrier clamping mechanism is loosenable to enable the second carrier to be moved along at least a portion of the length of the second post, and the carrier clamping mechanism is also tightenable to fix the second carrier at a certain location on the second post;

a second link having a proximal end pivotally coupled to the second carrier such that the second link is rotatable with respect to the second carrier about an axis that is defined by the pivotal coupling of the second carrier and the second link, the second link also having a distal end; and a second arm pivotally coupled to the distal end of the second link and extending from the second link such that the second arm being is rotatable with respect to the second link about an axis defined by the pivotal coupling of the second arm and the second link;

wherein the clear panel is also coupled to the second arm.

18. The adjustable food shield of claim 1, wherein the carrier is a first carrier, the link is a first link, the arm is a first arm, and the clear panel is a first panel, the adjustable food shield further comprising:

a second carrier coupled to the post, the second carrier including a carrier clamping mechanism, wherein the carrier clamping mechanism is loosenable to enable the second carrier to be moved along at least a portion of the length of the post, and the carrier clamping mechanism is also tightenable to fix the second carrier at a certain location on the post;

a second link having a proximal end pivotally coupled to the second carrier such that the second link is rotatable with respect to the second carrier about an axis that is defined by the pivotal coupling of the second carrier and the second link, the second link also having a distal end;

a second arm pivotally coupled to the distal end of the second link and extending from the second link such that the second arm is rotatable with respect to the second link about an axis defined by the pivotal coupling of the second arm and the second link; and a second panel coupled to the second arm.

19. The adjustable food shield of claim 18, wherein the first carrier and link are comprised in a first panel mounting assembly, and the second carrier and link are comprised in a second panel mounting assembly, and wherein the second carrier is inverted with respect to the first carrier.

20. The adjustable food shield of claim 18, wherein the first carrier and link are comprised in a first panel mounting assembly, and the second carrier and link are comprised in a second panel mounting assembly, and wherein the axes of rotation of the two links are coincident.

21. The adjustable food shield of claim 18, wherein the first carrier and link are comprised in a first panel mounting assembly, and the second carrier and link are comprised in a second panel mounting assembly, and wherein the axes of rotation of the two links intersect.

22. The adjustable food shield of claim 1, wherein the position of the clear panel can be adjusted without the use of tools.

23. A method of protecting displayed food items, the method comprising:

providing a food shield of claim 1 comprising at least one post having a longitudinal axis defining a length, wherein the post is vertically oriented relative to a horizontal surface, with food being positioned behind a rear side of the post; a carrier coupled to the post, the carrier including a carrier clamping mechanism, wherein the carrier clamping mechanism is loosenable to enable the carrier to be moved along at least a portion of the length of the post, and the carrier clamping mechanism is also tightenable to fix the carrier at a certain location on the post; a link having a proximal end pivotally coupled to the carrier such that the link is rotatable with respect to the carrier about an axis that is defined by the pivotal coupling of the carrier and the link, the link also having a distal end; an arm pivotally coupled to the distal end of the link and extending from the link such that the arm is rotatable with respect to the link about an axis defined by the pivotal coupling of the arm and the link; and a clear panel coupled to the arm such that the clear panel is movable to different positions by rotating the link, the arm, or both; and rotating the link, the arm, or both to position the clear panel in a certain position such that the clear panel is between the displayed food items and a viewing location, with the panel being forward of a front side of the post and the distal end of the link being completely forward of the front side of the post, thereby permitting the post to be positioned closer to the food while still permitting the panel to be forward of the food by a specified distance.

24. The method of claim 23, further comprising:

engaging a link fixing mechanism and an arm fixing mechanism to hold the clear panel in the certain angular position.

25. The method of claim 23, further comprising adjusting the position of the carrier on the post in conjunction with rotating the link, the arm, or both, to position the clear panel in a combination of a certain angular position and a certain translational location.

* * * * *